US007540330B2

(12) United States Patent
Orr et al.

(10) Patent No.: US 7,540,330 B2
(45) Date of Patent: Jun. 2, 2009

(54) SPRINKLER COVER

(75) Inventors: Shawn G Orr, Grand Rapids, MI (US); Andrew T Thompson, Hastings, MI (US); Scott T Franson, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 209 days.

(21) Appl. No.: 11/239,983

(22) Filed: Sep. 30, 2005

(65) Prior Publication Data

US 2006/0060671 A1 Mar. 23, 2006

Related U.S. Application Data

(63) Continuation of application No. 10/742,258, filed on Dec. 21, 2003, now abandoned.

(60) Provisional application No. 60/436,682, filed on Dec. 27, 2002.

(51) Int. Cl.
*A62C 37/08* (2006.01)

(52) U.S. Cl. ..... 169/37; 169/41; 169/42; 239/288.5

(58) Field of Classification Search ..... 239/288–288.5; 169/37–42

See application file for complete search history.

(56) References Cited

U.S. PATENT DOCUMENTS

| | | | | |
|---|---|---|---|---|
| 3,388,747 A | | 6/1968 | Hodnett | |
| 3,727,695 A | | 4/1973 | Danton | 169/37 |
| 3,801,014 A | | 4/1974 | Cantales | 239/104 |
| 4,366,866 A | | 1/1983 | Sweeney | 169/37 |
| 4,706,759 A | | 11/1987 | Grasseschi | 169/51 |
| 4,830,118 A | | 5/1989 | Capasso | 169/90 |
| 5,020,601 A | * | 6/1991 | Retzloff et al. | 169/37 |
| 5,080,176 A | | 1/1992 | Polan et al. | 169/37 |
| 5,097,906 A | * | 3/1992 | Polan | 169/37 |
| 5,152,344 A | | 10/1992 | Fischer et al. | 169/37 |
| 5,632,339 A | | 5/1997 | Fenske et al. | 169/37 |
| 6,131,822 A | | 10/2000 | Farmer, Jr. | 239/288 |
| 6,308,784 B1 | | 10/2001 | Mears | 169/37 |
| 6,669,111 B2 | | 12/2003 | Vinson et al. | 239/288 |

FOREIGN PATENT DOCUMENTS

| | | |
|---|---|---|
| GB | 2187951 | 9/1987 |
| JP | 3292968 | 12/1991 |
| JP | 1071215 | 3/1998 |
| JP | 11235397 | 8/1999 |
| JP | 11267243 | 10/1999 |
| JP | 200014824 | 1/2000 |

* cited by examiner

*Primary Examiner*—Christopher S Kim
(74) *Attorney, Agent, or Firm*—Harness, Dickey & Pierce, P.L.C.

(57) ABSTRACT

A sprinkler head cover including an end wall and a side wall extending from and around the end wall to form a cavity therebetween. The cavity is sized for receiving a deflector and arms of a sprinkler head. The side wall is adapted for engaging the sprinkler head to thereby releasably mount the cover to the sprinkler head.

25 Claims, 6 Drawing Sheets

SPRINKLER COVER

This application is a continuation application of U.S. patent application Ser. No. 10/742,258, filed Dec. 21, 2003, entitled SPRINKLER COVER, which claims priority from U.S. provisional application Ser. No. 60/436,682, filed Dec. 27, 2002, entitled SPRINKLER COVER, and are incorporated herein by reference in their entirety.

TECHNICAL FIELD AND BACKGROUND OF THE INVENTION

The present invention relates to a cover for a sprinkler head, which provides protection to the deflector of the sprinkler head during transport and during installation and, further, facilitates handling of the sprinkler head.

SUMMARY OF THE INVENTION

The present invention is directed to a cover for a fire protection sprinkler head. The cover is adapted to releasably engage the sprinkler head so that the cover will remain attached to the sprinkler head during handling and installation to ease handling and, further, protect the deflector during normal handling and installation of the sprinkler head.

In one form, a cover of the present invention includes an end wall and a side wall, which extends from and around the end wall to form a cavity. The cavity is sized for receiving at least a deflector and the arms of a sprinkler head. The side walls are adapted for engaging the arms of the sprinkler head to thereby releasably mount the cover to the sprinkler head.

In one aspect, the side wall includes at least one groove formed therein, which is sized for receiving one of the arms of the sprinkler head. Preferably, the side wall includes a pair of the grooves, with each groove adapted for receiving one of the arms of the sprinkler head. In a further aspect, the side wall includes at least one guide surface adjacent the groove for guiding the arm into the groove when the cover is mounted on the sprinkler head. For example, the side wall has a varying wall thickness, which forms the guide surface.

In other aspects, the side wall has first and second wall sections with a first wall thickness and third and fourth wall sections with a variable second wall thickness, which is greater than the first wall thickness. The grooves are preferably located at the third and fourth wall sections. In a further aspect, the first and second wall sections comprise flexible wall sections wherein the first and second wall sections flex when the sprinkler head arms are inserted into the cavity of the cover and, further, flex and are tensioned when the sprinkler head is rotated in the cavity to position the arms in the grooves.

In another aspect, the side wall is further adapted to releasably engage the deflector of the sprinkler head when the sprinkler head is inserted into the cover. For example, the side wall may include at least one rib, which releasably engages the deflector. Preferably, the side wall includes a plurality of the ribs.

In a further aspect, the rib is preferably positioned in proximity to the end wall.

According to yet other aspects, the end wall includes a drain opening. Furthermore, the end wall may include a gripping surface for applying a disengaging force to the cover for disengaging the cover from the sprinkler head.

According to yet another form of the invention, a sprinkler head cover includes an end wall and a side wall which extends from and around the end wall to form a cavity. The cavity is sized for receiving at least a deflector and arms of the sprinkler head, with the side wall adapted for engaging the deflector of the sprinkler head to thereby releasably mount the cover to the sprinkler head when the sprinkler head is inserted into the cavity of the cover.

In one aspect, the side wall includes an inner surface and at least one rib at the inner surface proximate the end wall for releasably engaging the deflector.

In a further aspect, the rib provides a snap-fit engagement between the cover and the deflector.

In yet another aspect, the outer surface of the end wall includes a projecting structure, such as a flange, that provides an engagement surface. Optionally, the projecting structure is oriented such that it provides an indication of the orientation of the sprinkler head to which the cover is mounted to facilitate installation of the sprinkler head.

Accordingly, the present invention provides a cover for a sprinkler head, which is adapted to releasably mount to a fire protection sprinkler head in a manner to protect the deflector and operating mechanism from damage during transit, normal handling, and installation and, further, in a manner to provide a quick release of the cover from the sprinkler head. In addition, the cover provides a gripping surface and an optional orientation indicator for the sprinkler head to ease installation of the sprinkler head on the piping of the fire protection system.

These and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENTS

Referring to FIGS. 1-10, the numeral 10 generally designates a fire protection sprinkler head cover of the present invention. Cover 10 is adapted to releasably mount on fire protection sprinkler head 12 (FIGS. 1-4) in such a manner to protect the deflector of the sprinkler head and, further, in a manner that facilitates the handling and installing of the sprinkler head in a fire protection system. As will be more fully described below, cover 10 is adapted to releasably mount to the sprinkler head and to releasably engage either the sprinkler head deflector or the sprinkler head arms or both.

Figure 1:
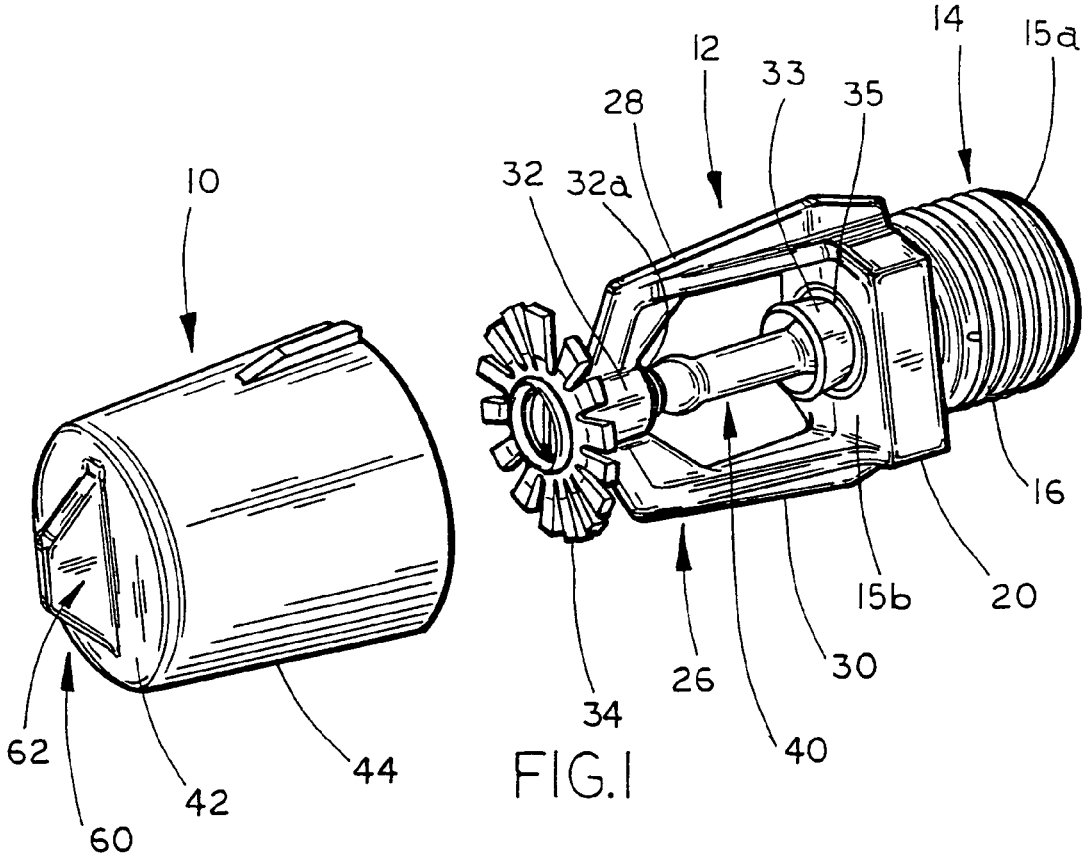
FIG. 1 is an exploded perspective view of a cover for a fire protection sprinkler head of the present invention.

As best seen in FIG. 1, fire protection sprinkler head 12 includes a base 14, with a transverse passage 15, which defines an inlet opening 15*a* and an outlet opening 15*b* for the sprinkler head, and a frame 26, which supports a deflector 34. Base 14 includes a threaded portion 16 for coupling to a supply pipe of a fire protection system and a flange 20, which extends around outlet opening 15*b*. Frame 26 extends from flange 20 and, in the illustrated embodiment, is formed by a pair of arms 28 and 30 that are joined at their distal ends by a threaded boss 32 to which deflector 34 is mounted.

Outlet opening 15*b* is closed by cup-shaped member 33 and a ring-shaped seal which is retained in opening 15*b* in its closed position by a heat sensitive trigger 40. In the illustrated embodiment, heat sensitive trigger 40 comprises a temperature sensitive member which is positioned between the lower end 32*a* of threaded boss 32 and cup-shaped member 33. In the illustrated embodiment, the temperature sensitive member comprises an elongated frangible bulb, which is set in place by a set screw that extends through threaded boss 32. Positioned between flange 20 and cup-shaped member 33 is an annular plate spring 35, such as a Belleville spring, which is biased when cup-shaped member 33 is held in its closed position by trigger 40 but releases its stored energy when trigger 40 is broken and no longer holds cup-shaped member 33 over opening 15*b*. As is known in the art, upon detecting a temperature associated with a fire, heat sensitive trigger 40 will break releasing the pressure on spring 35, which will eject the remaining portions of the trigger and cup-shaped member 33 when it releases its energy and, further, will be lifted off opening 15*b* under the force of the water pressure flowing through outlet opening 15*b*.

Figure 2:
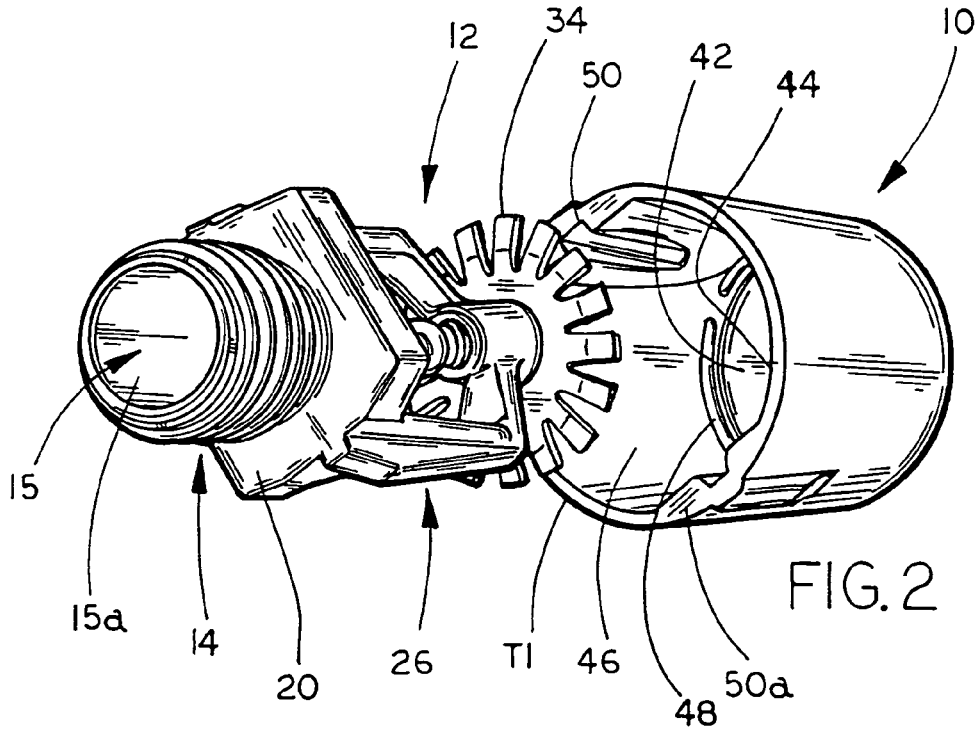
FIG. 2 is another perspective view of the cover mounted on the sprinkler head of FIG. 1.
Figure 3:
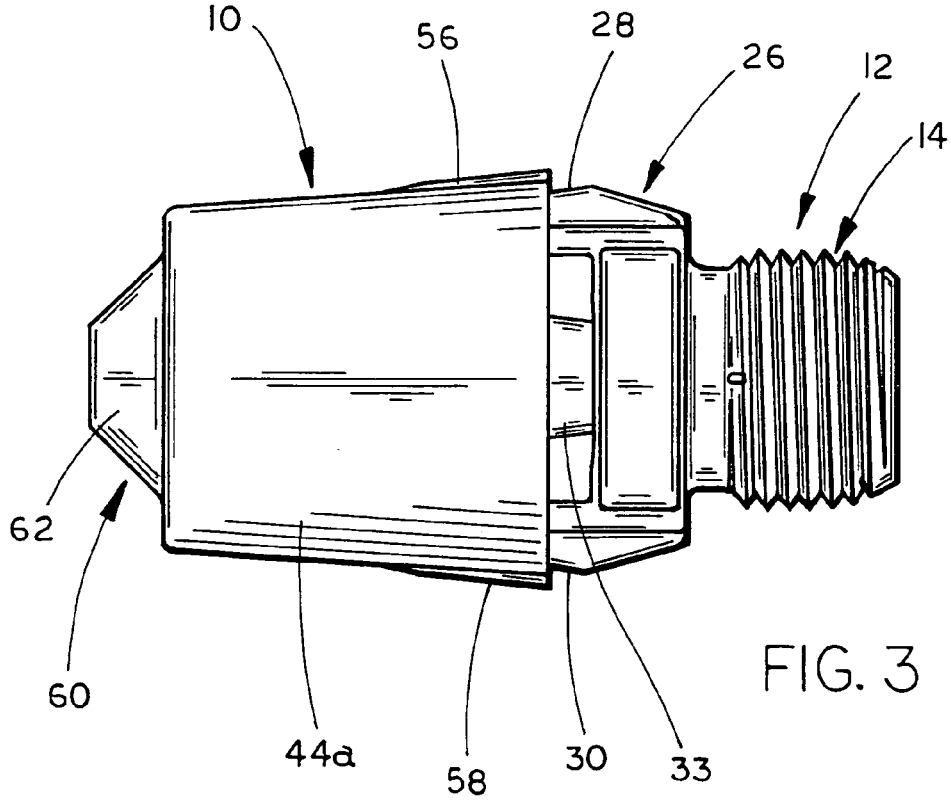
FIG. 3 is a side view of the cover mounted to the sprinkler head.

Referring to FIG. 2, cover 10 is adapted to releasably engage arms 28 and 30 and, further, releasably adapted to engage deflector 34. In the illustrated embodiment, cover 10 is formed from an end wall 42 and a generally cylindrical side wall 44 that extends from and around end wall 42 to form a generally cylindrical cavity 46 therebetween. Cover 10 is preferably formed from a plastic material, such as polyethylene, and is formed by molding, such as injection molding. Cavity 46 is sized to receive at least deflector 34 and, further, at least a portion of arms 28 and 30 of sprinkler head 10.

Figure 4:
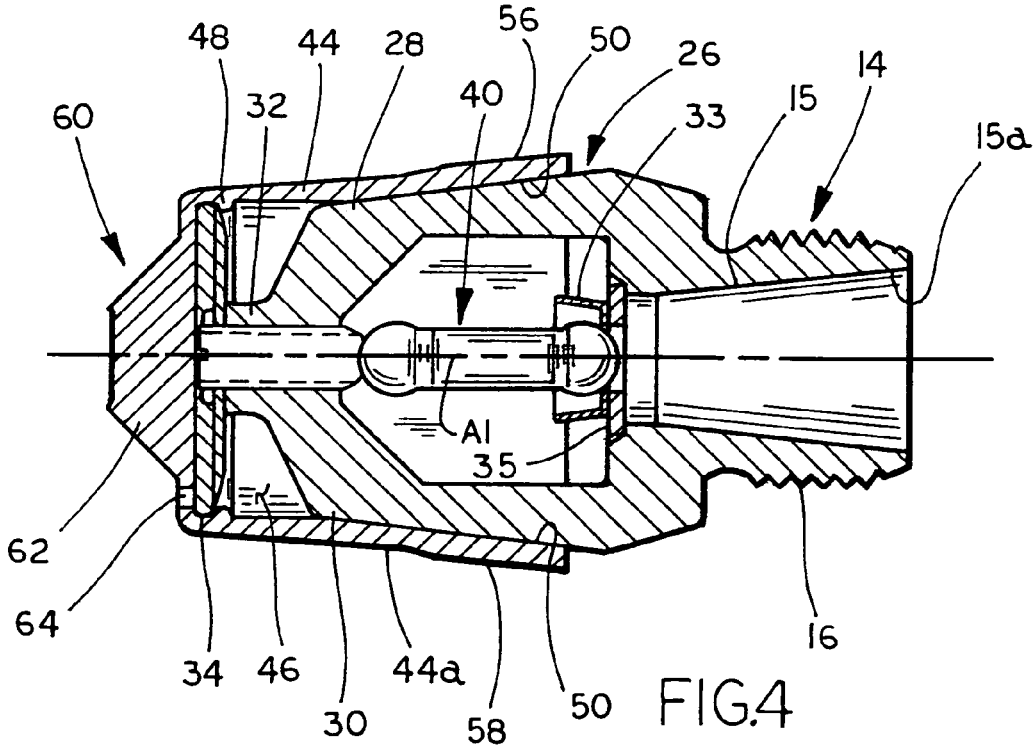
FIG. 4 is a cross-section view taken along line IV-IV of FIG. 3.
Figure 5:
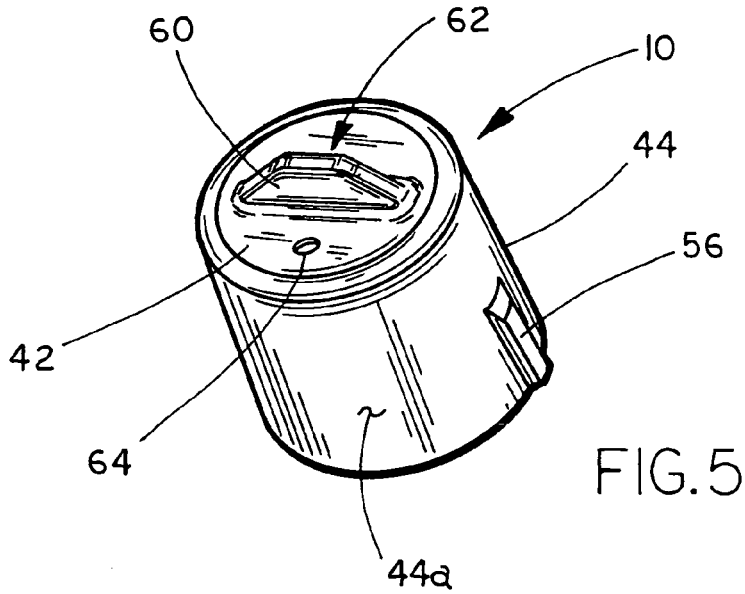
FIG. 5 is a perspective view of the cap of the present invention.
Figure 6:
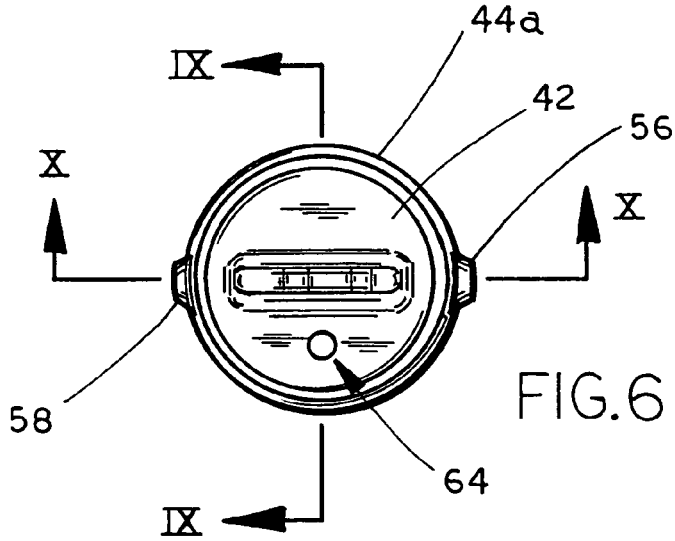
FIG. 6 is a top plan view of the cap of FIG. 5.
Figure 7:
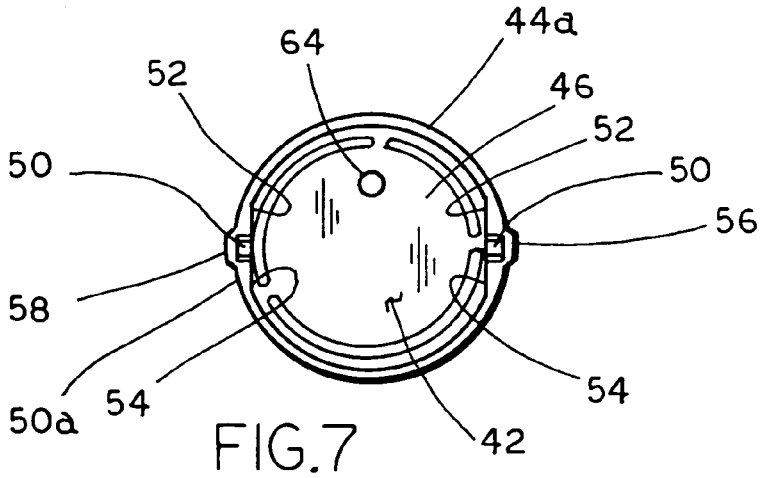
FIG. 7 is a bottom plan view of the cap of FIG. 5.
Figure 8:
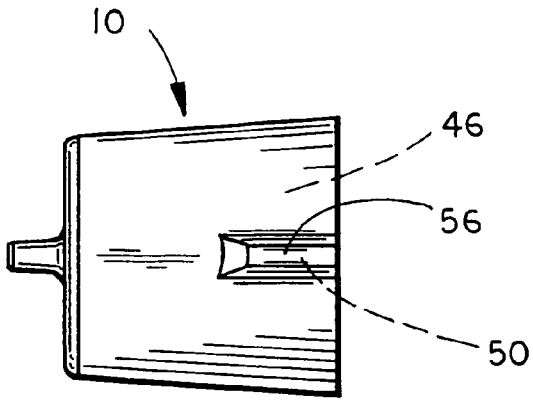
FIG. 8 is a side elevation view of the cap of FIG. 5.

Referring to FIGS. 2, 4, 9, and 10, side wall 44 includes one or more annular ribs 48 on its inner surface, which project radially inward into cavity 46. Ribs 48 are spaced from but generally proximate end wall 42. For example, ribs 48 may be spaced from end wall 42 a distance in a range of 0.55 to 0.65 inches. Furthermore, ribs 48 include terminal ends 48*a* and 48*b* which are spaced from the terminal ends of the adjacent ribs which are preferably all located in a common plane. Side wall 44 has a side wall thickness T1 in a range of 0.030 to 0.060 inches and, more preferably, in a range of 0.04 to 0.05 inches. In this manner, side wall 44 is relatively flexible such that when deflector 34 is inserted into cavity 46 and is urged against ribs 48, side wall 44 will flex to permit deflector 34 to pass ribs 48 such that deflector 34 will be trapped in cavity 46 between ribs 48 and end wall 42. As best seen in FIG. 4, ribs 48 have a semi-circular curved cross-section and provide a generally smooth snap-fit engagement between deflector 34 and cover 10.

Figure 9:
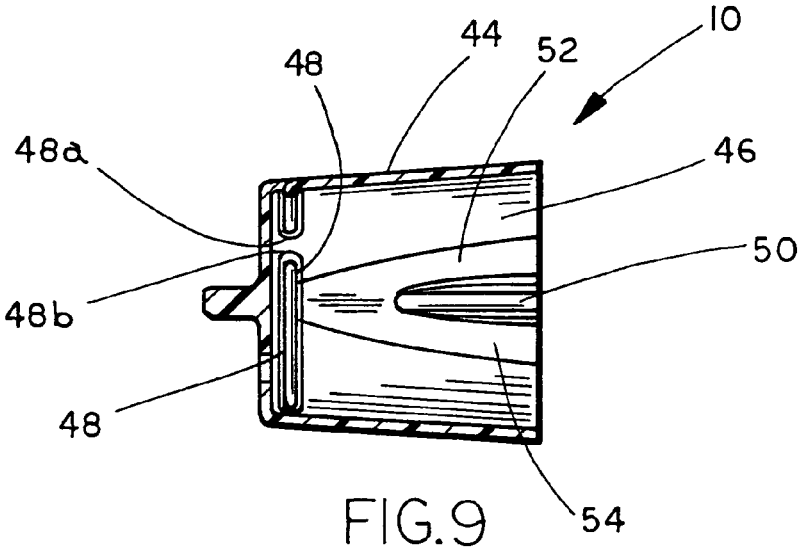
FIG. 9 is a cross-section view taken along line IX-IX of FIG. 6.
Figure 10:
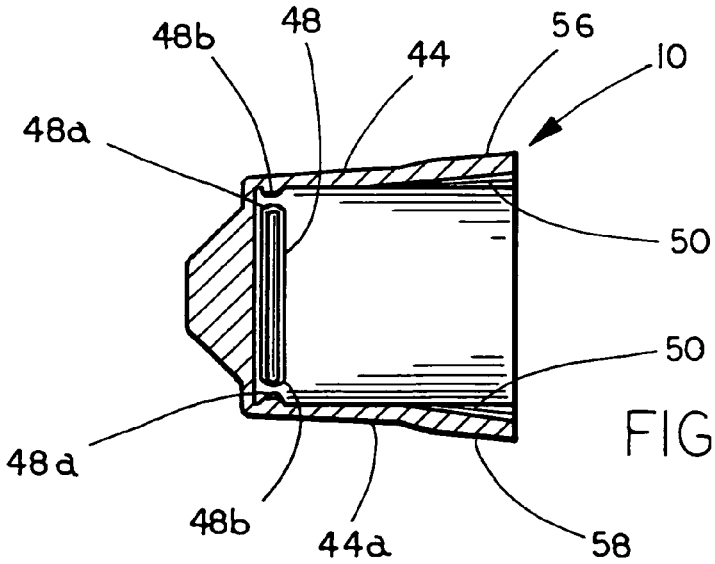
FIG. 10 is a cross-section view taken along line X-X of FIG. 6.

In addition, side wall 44 optionally includes one or more grooves 50 (FIGS. 4, 9, and 10) that are formed in side wall 44 preferably in sections of side wall 44 that have an increased thickness 50*a* to thereby locally stiffen side wall 44 around grooves 50. As best seen in FIG. 2, side wall 44 includes two sections 50*a* (FIG. 7) that have a variable increased thickness and form guide surfaces 52 and 54 on either side of the respective grooves (50). As best seen in FIGS. 4 and 9, grooves 50 are tapered and terminate at a medial portion of side wall 44. Optionally and preferably, side wall 44 includes tapered ribs 56 and 58 (FIGS. 4, 6, 7, and 10) which extend along the outer surface 44*a* of side wall 44, which provide increased stiffness to side wall 44 along grooves 50 and, further, provide a gripping surface for an operator placing the cover onto or removing cover 10 from the sprinkler head.

In addition, end wall 42 may include a gripping surface 60 such as provided by a projecting structure, such as a tab or flange 62 (FIGS. 3-6). In the illustrated embodiment, flange 62 comprises a trapezoidal-shaped flange, which is optionally and preferably aligned in the same plane as grooves 50 and ribs 56 and 58. In this manner, flange 62 can provide an indication of the orientation of the sprinkler head when the sprinkler head is mounted in the cover—or when the cover is mounted on the sprinkler head. Optionally and preferably, end wall 42 includes a drainage opening 64 that permits water, which may be leaking from the respective sprinkler head, to be released through the respective opening rather than accumulating in cavity 46.

To mount cover 10 on a sprinkler head, such as sprinkler head 12, the deflector and arms are first inserted into the cavity along an insertion axis A1 with arms oriented along a plane that is generally orthogonal to the plane extending through grooves 50. In this manner, flexible side wall portions 44*a* of side wall 44 deflect or flex outwardly. When side wall portions 44*a* deflect or flex, ribs 28 may also deflect, though not to the same degree as side wall portions 44*a*. In this configuration, deflector 34 can be pushed passed ribs 48 with a downward pressure. After deflector 34 is pushed past ribs 48 and engaged and captured by ribs 48 between ribs 48 and end wall 42, cover 10 or sprinkler head 12 may then be rotated such that grooves 50 align with arms 28 and 30. Initially, arms 28 and 30 will contact guide surfaces 52 or 54 which causes grooves 50 to deflect radially outward and flexible side wall portions 44*a* of side wall 44 to stretch and to flatten, which generates a spring force that urges grooves 50 into engagement with arms 28 and 30. In some configurations, this spring force may be reduced to essentially zero when arms 28 and 30 are seated in grooves 50. In this orientation, cover 10 is securely mounted to sprinkler head 12 until a sufficient torque or rotational force is applied to cover 10 to disengage grooves 50 from arms 28 and 30, which in some cases may be sufficient to disengage deflector from ribs 48 and thereby demount cover 10 from sprinkler head 12. In some applications, additional axial force may be needed to disengage the deflector 34 from ribs 48. However, where the retention of cover 10 on sprinkler head 12 relies solely on the engagement between the arms and grooves 50, the twisting of the cover about the insertion axis to disengage arms 28 and 30 from grooves 50 should be sufficient to remove cover 10 from sprinkler head 12.

Figure 11:
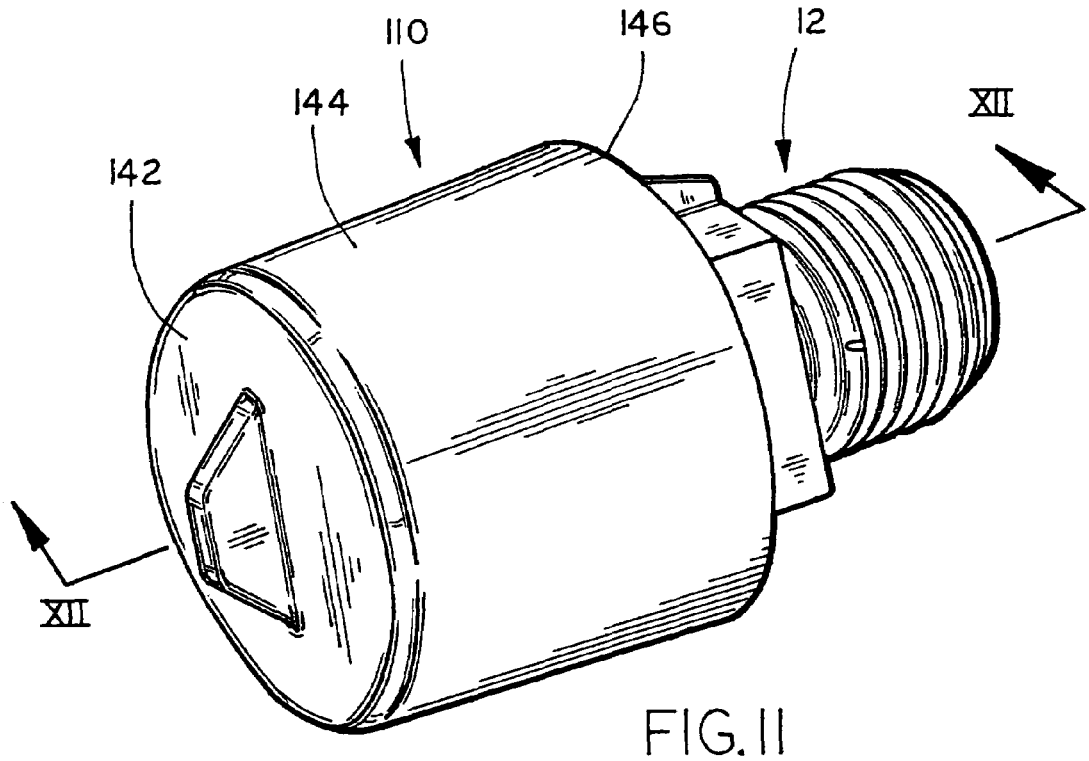
FIG. 11 is a perspective view of a second embodiment of a cover of the present invention mounted on a sprinkler head.
Figure 12:
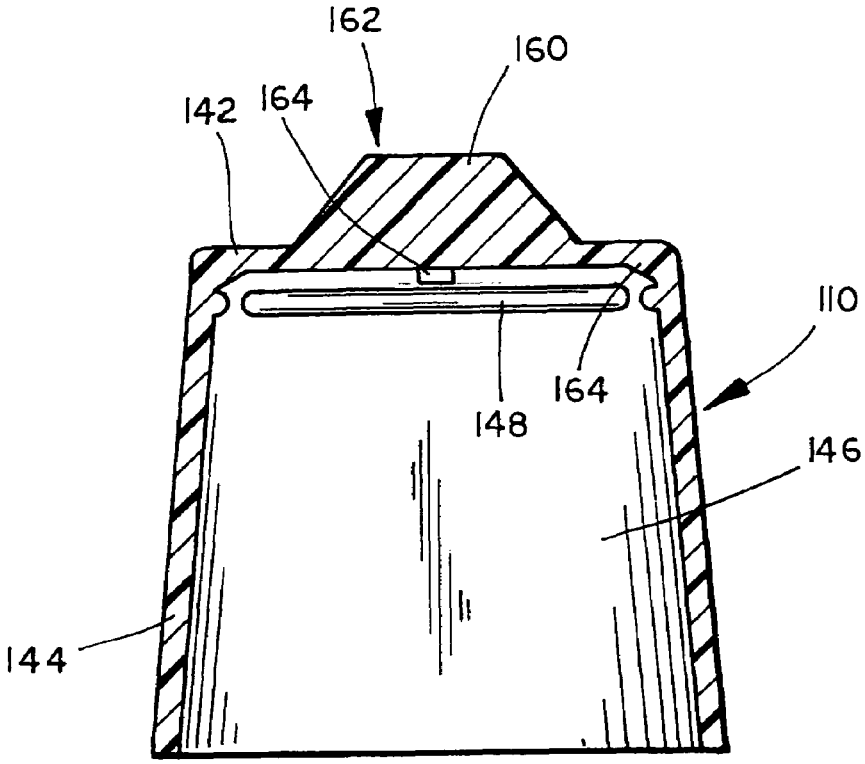
FIG. 12 is a cross-section view taken along line XII-XII of FIG. 11 with the details of the sprinkler head omitted for clarity.
Figure 13:
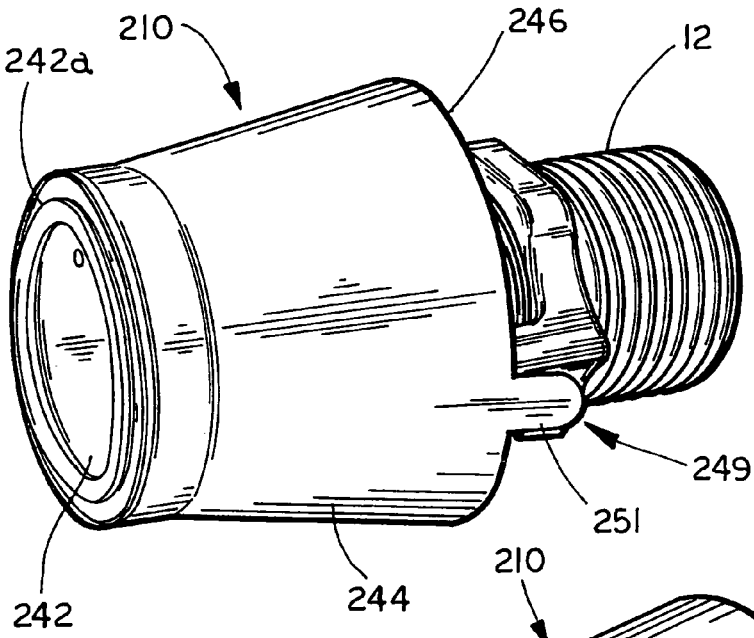
FIG. 13 is a perspective view of yet another embodiment of the cover of the present invention illustrated mounted to a sprinkler head.

Referring to FIGS. 11, 12, and 13, the numeral 110 designates another embodiment of the cover of the present invention. Cover 110 is of similar construction to cover 10 and includes an end wall 142 and a generally cylindrical side wall 144 that extends from end wall 142 to form a cavity 146 for receiving the deflector and at least a portion of the arms of a sprinkler head, such as sprinkler head 12. Side wall 144 has a substantially uniform thickness and similar to side wall 44 includes a plurality of spaced apart inwardly projecting ribs 148, which provide a snap-fit coupling between cover 110 and the deflector, such as deflector 34 of sprinkler head 12. In addition, similar to the previous embodiment, end wall 142 includes an engagement surface 160, such as provided by a projecting member or protuberance such as flange 162.

Referring to FIG. 12, cover 110 optionally includes one or more ribs 164 which project from end wall 142 and form gussets to locally reinforce end wall 142 and, further, may provide a limited lateral restraint for the deflector and, hence, the sprinkler positioned in cavity 146 of cover 110. For example, referring to FIG. 1, a sprinkler head deflector, such as sprinkler head deflector 34, may include a plurality of projecting tines and interstices between the respective tines, with the ribs 164 being aligned between the respective tines to limit rotation of the sprinkler head within cover 110. In this manner, the sprinkler head positioned in cover 110 may be oriented with respect to the cover but by virtue of the orientation of the deflector tines with respect to ribs 164.

Figure 14:
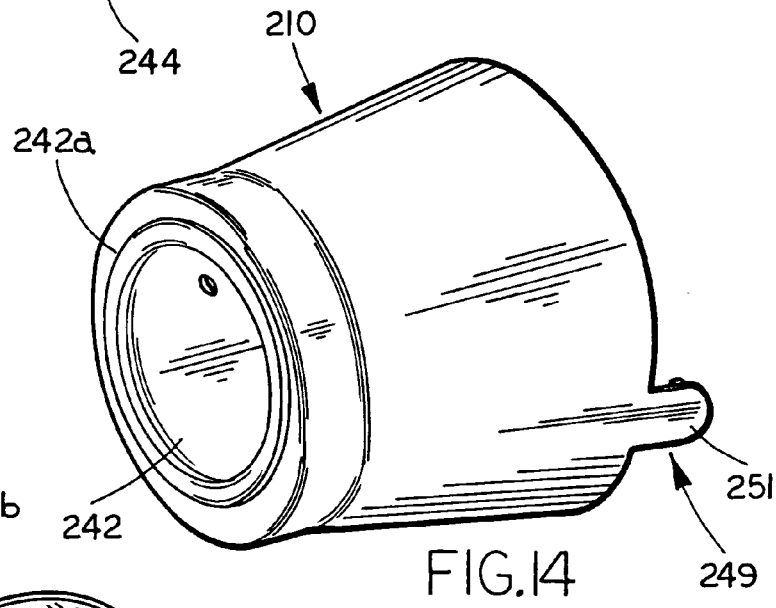
FIG. 14 is a bottom perspective view of the cover of FIG. 13.

Referring to FIGS. 13 and 14, the numeral 210 designates another embodiment of the cover of the present invention. Cover 210 is of similar construction to cover 110 and includes a base wall 242 and a generally cylindrical side wall 244 that extends from base wall 242 to form a cavity 246 in which a deflector of a sprinkler head, such as sprinkler head 12, and at least a portion of the deflector head arms are positioned similar to the previous embodiments. As best seen in FIG. 16, ribs 248 are formed on the inner surface of side wall 244 and provide a snap-fit coupling for cover 210 to a sprinkler head deflector, such as deflector 34 of sprinkler head 12. Again, ribs 248 may be formed from a single rib or may be formed from a plurality of annularly spaced ribs, such as illustrated in reference to the previous embodiments.

Figure 15:
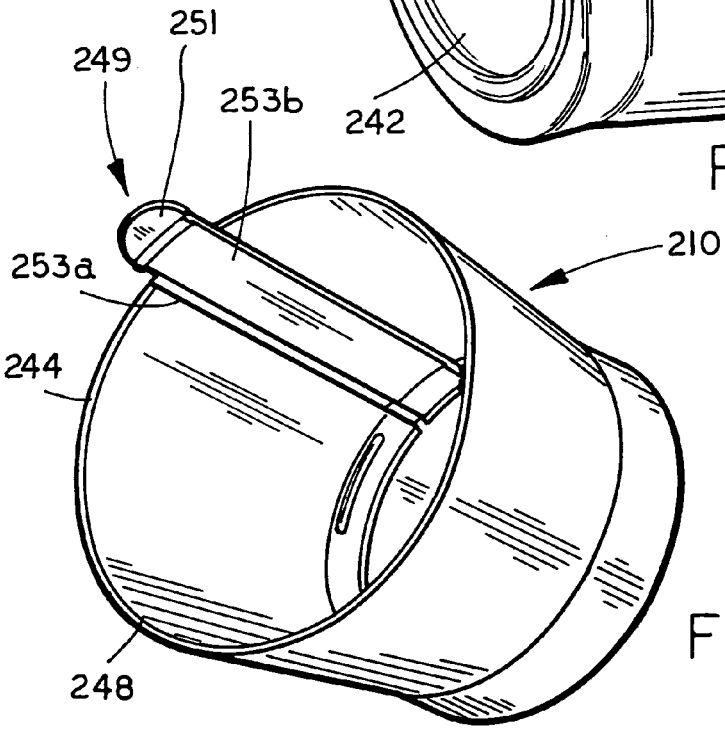
FIG. 15 is a bottom perspective view of the cover of FIG. 14.

In the illustrated embodiment, cover 210 has a generally frusto-conical shape with side wall 244 projecting from end wall 242 at a greater angle than the side walls of the previous embodiments. Similar to the previous embodiment, side wall 244 has a substantially continuous wall thickness but includes formed therein a tear-away strip 249, which permits the cover 210 to be quickly removed from the sprinkler head when the removal of the cover is desired. Referring to FIGS. 15 and 16, cover 210 optionally includes an annular rib 242*a* that provides reinforcement to end wall 242 to facilitate the tearing of tear-away strip 249. As best seen in FIG. 16, side wall 244 includes a projecting tab 251 and, further, a pair of spaced apart longitudinal grooves 253*a* and 253*b* on either side of the portion of side wall 244 that forms tab 251 to form tear-away strip 249 which, as previously noted, permits cover 210 to be quickly and easily removed from the sprinkler head when it is desired that the cover 210 is removed. Tab 251 also optionally provides a gripping surface to facilitate the removal of cover 210 from the respective sprinkler head. Furthermore, tab 251 may be used as a reference to orient cover 210 with respect to the sprinkler head.

Optionally, cover 210 may incorporate positioning grooves, such as grooves 50, to provide engagement with respective arms of the sprinkler head, which also provide an alignment mechanism for orienting the cover with respect to the sprinkler head and, further, may optionally include another gripping or engagement surface, such as a projecting tab or flange, such as flanges 62 or 162 in the previous embodiments.

While several forms of the invention have been shown and described, changes and modifications would be appreciated to one of ordinary skill in the art. For example, the ribs may comprise a unitary annular rib. Also, the cover may be formed without ribs or without grooves. When the cover omits ribs, retention of the cover on the sprinkler head is achieved by a friction fit between the arms and the grooves. For example, the side wall may be formed from or include portions formed from a higher friction material, such as material with a rubber or silicone component, for example. Or, grooves may have a gripping surface formed or provided thereon, which increases the friction between the arms and the cover. Similarly, if the grooves are omitted, retention of the cover on the sprinkler head may be solely through the snap-fit engagement between the ribs and the deflector. The alignment function may be achieved by other means. For example, the cover may have markings on its exterior surface for aligning with the arms of the sprinkler head, with the orientation of the sprinkler head maintained by friction between the side wall of the cover and the arms of the sprinkler head, as noted above. Alternately, an insert could be place in the cover that would fix the orientation of the sprinkler head in the cover. Furthermore, the side wall may include one or more drainage openings. Other modifications may include a cross-shaped engagement structure to provide a plurality of engagement surfaces for the operator who is mounting the cover or removing the cover. Furthermore, the ribs may be spaced further away from end wall to accommodate a wider range of deflector designs. Therefore, it will be understood that the embodiments shown in the drawings and described above are merely for illustrative purposes, and are not intended to limit the scope of the invention, which is defined by the claims that follow as interpreted under the principles of patent law including the doctrine of equivalents.

We claim:

1. A sprinkler assembly comprising:

a sprinkler head having a base with a passage therethrough, a deflector, a pair of arms extending from said base and supporting said deflector, a heat responsive unit supporting a plug in said passage and being activated by heat to release said plug from said passage, said deflector being fixed to said pair of arms after said heat responsive unit is activated and adapted for deflecting fire suppressant fluid being discharged from said passage; and a plastic cover, said cover including an end wall, a side wall extending from and around said end wall to form a cavity therebetween, and said cavity receiving said deflector and said arms of said sprinkler head, said side wall including at least one annular rib projecting from said side wall inwardly into said cavity and spaced from said end wall, said end wall, said side wall and said at least one annular rib all being integrally formed from plastic, said deflector captured between said rib and said end wall when said sprinkler head is inserted into said cavity of said cover wherein said rib mounts said cover onto said sprinkler head and retains said cover on said sprinkler head by engagement with said deflector.

2. The sprinkler assembly according to claim 1, wherein said side wall engages said pair of arms of said sprinkler head when said cover is mounted on said sprinkler head.

3. The sprinkler assembly according to claim 1, wherein said side wall includes at least one groove formed therein, said groove receiving one of said arms of said sprinkler head.

4. The sprinkler assembly according to claim 3 wherein said side wall further includes at least one guide surface adjacent said groove guiding said one of said arms into or out of said groove when said sprinkler head is rotated in said cavity.

5. The sprinkler assembly according to claim 4, wherein said side wall has a first wall thickness and a second wall thickness, said second wall thickness being greater than said first wall thickness and forming said guide surface.

6. The sprinkler assembly according to claim 1, wherein said side wall includes a pair of grooves formed therein, said grooves receiving said arms when said cover is mounted to said sprinkler head.

7. The sprinkler assembly according to claim 6, wherein said side wall has first and second wall sections each with a first wall thickness and third and fourth wall sections each with a second wall thickness, said second wall thickness being greater than said first wall thickness, and said grooves located at said third and fourth wall sections.

8. The sprinkler assembly according to claim 1, wherein said rib provides a snap-fit engagement between said cover and said deflector.

9. The sprinkler assembly according to claim 1, further comprising a gripping surface for disengaging said cover from said sprinkler head.

10. The sprinkler assembly according to claim 9, wherein said cover includes a projecting tab, said projecting tab forming said gripping surface.

11. The sprinkler assembly according to claim 10, wherein said end wall includes said projecting tab.

12. The sprinkler assembly according to claim 1, wherein said side wall has an inner diameter greater than an outer diameter of said deflector.

13. The sprinkler assembly according to claim 6, wherein said cover comprises a cup-shaped body having an open first end and a closed second end, said second end being formed by said end wall, said side wall having an inner surface, said rib extending inwardly from said inner surface into said cavity, and said grooves extending inwardly from said open first end toward said end wall.

14. The sprinkler assembly according to claim 13, wherein said side wall includes a plurality of said ribs.

15. The sprinkler assembly according to claim 6, wherein said side wall includes first and second flexible wall sections between said grooves, said first and second wall sections flexing outwardly when said arms are inserted into said cavity and said first and second wall sections flexing inwardly when said arms are rotated into said grooves.

16. The sprinkler assembly according to claim 15, wherein each of first and second wall sections have a first wall thickness, said side wall further having a second wall thickness adjacent said grooves, said second wall thickness being greater than said first wall thickness.

17. A sprinkler assembly comprising:

a sprinkler head having a base, a deflector, and a pair of arms extending from said base and supporting said deflector; and p1 a cover, said cover including an end wall, a side wall extending from and around said end wall to form a cavity therebetween, and said cavity receiving said deflector and said arms of said sprinkler head, said side wall including at least one annular rib projecting from said side wall inwardly into said cavity and spaced from said end wall, said deflector captured between said rib and said end wall when said sprinkler head is inserted into said cavity of said cover wherein said rib mounts said cover onto said sprinkler head and retains said cover on said sprinkler head by engagement with said deflector, wherein said side wall engages said pair of arms of said sprinkler head when said cover is mounted on said sprinkler head.

18. A sprinkler assembly comprising:

a sprinkler head having a base, a deflector, and a pair of arms extending from said base and supporting said deflector; and a cover, said cover including an end wall, a side wall extending from and around said end wall to form a cavity therebetween, and said cavity receiving said deflector and said arms of said sprinkler head, said side wall including at least one annular rib projecting from said side wall inwardly into said cavity and spaced from said end wall, said deflector captured between said rib and said end wall when said sprinkler head is inserted into said cavity of said cover wherein said rib mounts said cover onto said sprinkler head and retains said cover on said sprinkler head by engagement with said deflector, wherein said side wall includes at least one groove formed therein, said groove receiving one of said arms of said sprinkler head.

19. A sprinkler assembly comprising:

a sprinkler head having a base, a deflector, and a pair of arms extending from said base and supporting said deflector; and a cover, said cover including an end wall, a side wall extending from and around said end wall to form a cavity therebetween, and said cavity receiving said deflector and said arms of said sprinkler head, said side wall including at least one annular rib projecting from said side wall inwardly into said cavity and spaced from said end wall, said deflector captured between said rib and said end wall when said sprinkler head is inserted into said cavity of said cover wherein said rib mounts said cover onto said sprinkler head and retains said cover on said sprinkler head by engagement with said deflector, wherein said side wall includes a pair of grooves formed therein, said grooves receiving said arms when said cover is mounted to said sprinkler head.

20. A sprinkler assembly comprising:

a sprinkler head having a base, a deflector, a pair of arms extending from said base and supporting said deflector; and a cover, said cover including an end wall, a side wall extending from and 360 degrees around said end wall to form a cavity therebetween, and said cavity receiving said deflector and said arms of said sprinkler head, said side wall including at least one annular rib projecting from said side wall inwardly into said cavity and spaced from said end wall, said deflector captured between said rib and said end wall when said sprinkler head is inserted into said cavity of said cover wherein said rib mounts said cover onto said sprinkler head and retains said cover on said sprinkler head by engagement with said deflector, wherein said cover includes a projecting tab forming a gripping surface.

21. A sprinkler assembly comprising:

a sprinkler head having a base, a deflector, a pair of arms extending from said base and supporting said deflector, a heat responsive unit supporting a plug in said passage and being activated by heat to release said plug from said passage, said deflector being fixed to said pair of arms after said heat responsive unit is activated and adapted for deflecting fire suppressant fluid being discharged from said passage; and a plastic cover, said cover including an end wall, a side wall extending from and around said end wall to form a cavity therebetween, and said cavity receiving said deflector and said arms of said sprinkler head, said side wall including a snap fit engagement with said deflector when said sprinkler head is inserted into said cavity of said cover wherein said snap fit engagement mounts said cover onto said sprinkler head and retains said cover on said sprinkler head by engagement with said deflector, said end wall and said side wall being integrally formed from plastic.

22. A sprinkler assembly comprising:

a sprinkler head having a base, a deflector, and a pair of arms extending from said base and supporting said deflector; and a cover, said cover including an end wall, a side wall extending from and around said end wall to form a cavity therebetween, and said cavity receiving said deflector and said arms of said sprinkler head, said side wall including a snap fit engagement with said deflector when said sprinkler head is inserted into said cavity of said cover wherein said snap fit engagement mounts said cover onto said sprinkler head and retains said cover on said sprinkler head by engagement with said deflector, wherein said side wall engages said pair of arms of said sprinkler head when said cover is mounted on said sprinkler head.

23. A sprinkler assembly comprising:

a sprinkler head having a base, a deflector, and a pair of arms extending from said base and supporting said deflector; and a cover, said cover including an end wall, a side wall extending from and around said end wall to form a cavity therebetween, and said cavity receiving said deflector and said arms of said sprinkler head, said side wall including a snap fit engagement with said deflector when said sprinkler head is inserted into said cavity of said cover wherein said snap fit engagement mounts said cover onto said sprinkler head and retains said cover on said sprinkler head by engagement with said deflector, wherein said side wall includes at least one groove formed therein, said groove receiving one of said arms of said sprinkler head.

24. A sprinkler assembly comprising:

a sprinkler head having a base, a deflector, and a pair of arms extending from said base and supporting said deflector; and a cover, said cover including an end wall, a side wall extending from and around said end wall to form a cavity therebetween, and said cavity receiving said deflector and said arms of said sprinkler head, said side wall including a snap fit engagement with said deflector when said sprinkler head is inserted into said cavity of said cover wherein said snap fit engagement mounts said cover onto said sprinkler head and retains said cover on said sprinkler head by engagement with said deflector, wherein said side wall includes a pair of grooves formed therein, said grooves receiving said arms when said cover is mounted to said sprinkler head.

25. A sprinkler assembly comprising:

a sprinkler head having a base, a deflector, and a pair of arms extending from said base and supporting said deflector; and a cover, said cover including an end wall, a side wall extending from and around said end wall to form a cavity therebetween, and said cavity receiving said deflector and said arms of said sprinkler head, said side wall including a snap fit engagement with said deflector when said sprinkler head is inserted into said cavity of said cover wherein said snap fit engagement mounts said cover onto said sprinkler head and retains said cover on said sprinkler head by engagement with said deflector, wherein said cover includes a projecting tab forming a gripping surface.

* * * * *

UNITED STATES PATENT AND TRADEMARK OFFICE

CERTIFICATE OF CORRECTION

PATENT NO. : 7,540,330 B2
APPLICATION NO. : 11/239983
DATED : June 2, 2009
INVENTOR(S) : Shawn G. Orr et al.

It is certified that error appears in the above-identified patent and that said Letters Patent is hereby corrected as shown below:

Col. 7, line 48, "p1" should be deleted.`

Signed and Sealed this

Twenty-seventh Day of October, 2009

David J. Kappos

David J. Kappos
*Director of the United States Patent and Trademark Office*